US010410479B2

(12) United States Patent
Beskitt et al.

(10) Patent No.: US 10,410,479 B2
(45) **Date of Patent: *Sep. 10, 2019**

(54) AUTOMATED TRANSACTION MACHINE WITH ARTICULATED NOTE ACCEPTOR-PRESENTER

(71) Applicant: Diebold Nixdorf Incorporated, North Canton, OH (US)

(72) Inventors: William Daniel Beskitt, Canton, OH (US); David Nikkel, Wooster, OH (US)

(73) Assignee: Diebold Nixdorf Incorporated, North Canton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/904,665

(22) Filed: Feb. 26, 2018

(65) Prior Publication Data

US 2018/0190081 A1 Jul. 5, 2018

Related U.S. Application Data

(63) Continuation of application No. 15/291,641, filed on Oct. 12, 2016, now Pat. No. 9,905,084, which is a continuation of application No. 14/880,324, filed on Oct. 12, 2015, now Pat. No. 9,646,465.

(51) Int. Cl.

| | |
|---|---|
| ***G07F 19/00*** | (2006.01) |
| ***G07D 11/40*** | (2019.01) |
| ***G07F 9/06*** | (2006.01) |

(52) U.S. Cl.
CPC ..... *G07F 19/205* (2013.01); *G07D 11/40* (2019.01); *G07F 9/06* (2013.01); *G07F 19/202* (2013.01)

(58) Field of Classification Search
None
See application file for complete search history.

(56) References Cited

U.S. PATENT DOCUMENTS

| | | | | |
|---|---|---|---|---|
| 2003/0173402 | A1 | 9/2003 | Ogawa et al. | |
| 2009/0160127 | A1* | 6/2009 | Kong | B65H 3/44 271/264 |
| 2014/0183817 | A1 | 7/2014 | Hwang et al. | |

FOREIGN PATENT DOCUMENTS

| | | |
|---|---|---|
| EP | 1926057 | 5/2008 |

OTHER PUBLICATIONS

International Search Report and Written Opinion for corresponding PCT applcation; 9 pages.

* cited by examiner

*Primary Examiner* — Kristy A Haupt
(74) *Attorney, Agent, or Firm* — Black, McCuskey, Souers & Arbaugh, LPA

(57) ABSTRACT

An automated transaction machine has a customer interface for operation of the machine and an opening in the customer interface through which notes may be deposited into or withdrawn from the machine via an articulated note acceptor-presenter located in an upper unit of the machine and operative to extend at least partially through the opening in the customer interface.

18 Claims, 10 Drawing Sheets

AUTOMATED TRANSACTION MACHINE WITH ARTICULATED NOTE ACCEPTOR-PRESENTER

CROSS-REFERENCE TO RELATED APPLICATIONS

This application is a Continuation of and claims priority to and the benefit of U.S. application Ser. No. 15/291,641, filed 12 Oct. 2016 which is a Continuation-in-Part of and claims priority to and the benefit of U.S. patent application Ser. No. 14/880,324 filed 12 Oct. 2015, the contents of both of which are hereby incorporated by reference in their entirety.

BACKGROUND

This relates in general to Automated Transaction Machines or Automated Teller Machines (ATMs), some of which are also known as Automated Banking Machines.

ATMs are generally designed and configured to carry out transactions such as dispensing cash and other notes or documents, accepting cash and checks and other notes or documents, and perform transactions such as funds transfers between accounts by connection to one or more financial networks, or other financial transfers or purchases. As referred to herein, the term automated transaction machine (ATM) includes automated banking machines and any machine or device, or combination of hardware and software which perform financial transactions or transfers of value, including but not limited to the acceptance, handling, storage, recycling and dispensing of documents, notes or any mediums of exchange, or exchange of payment for any goods or services.

Some ATMs are configured to accept deposits from users, such as cash (currency notes), coins, and checks, either as single items or in bulk or stack form, including mixed stacks of notes and checks (collectively "documents" or "items"). There is typically a single opening in the front of the ATM as part of the customer interface, which functions both as a receptacle or receiving place for items to be deposited with the machine, and to dispense, return or present items to the customer. The basic configuration of a single opening or single port or single throat in the customer interface for accepting and dispensing items or stacks of items is disclosed, for example, in U.S. Pat. Nos. 6,749,111 and 6,981,638 and 6,520,408 each owned by Diebold, Incorporated. In these types of machines, opposing pairs of belts are used to grip and transport single notes or a stack of notes into and throughout the machine as required, and to dispense notes also. Accordingly, the orientation of the deposit and dispense opening to a user through a customer interface of the machine is determined by the orientation of the belts.

Certain operational and ergonomic issues are present in connection with a single throat configuration ATM, such as the size, location, and orientation of the opening relative to the customer interface and/or the front of the machine, protection of the opening from the elements for machines installed out of doors, and closure of the opening when not in use. In some machines a motor operated door or gate covers the opening and is moved to an open position when a deposit or dispense transaction is performed and closed thereafter. The gate protects the interior of the machine from environmental factors such as rain and dirt, and against tampering or intrusion when the machine is not in use. In the simplest form, a presenter grips one or more notes or documents in a stack and advances the stack partially out through the opening when the gate is opened. The stack is held in that position and gripped under pressure for retrieval by the customer. When the stack is removed by the customer, the presenter retracts and the gate closes. If the stack is not removed within a set period of time by the customer, the presenter retracts, taking the stack with it and the gate then closes. In this general arrangement, the opening and the gate may be generally vertically oriented. This orientation can make the opening and the open or closed status of the gate difficult to easily perceive. The stack is typically advanced through the opening in a path perpendicular to the opening and gate. Also, the limited motion of the stack only partially through the opening can make it difficult for some customers to recognize the presence of the stack and retrieve it before it is retracted. Indicator lights proximate to the opening have been added to address this issue. In an alternative arrangement, the opening faces upward and the customer must reach into the opening to retrieve the stack. Appropriate timing of the closing of the gate and rate of closure is required to avoid having the gate close on a customer's hand. For deposits, the customer must partially insert a bill or stack of bills and/or notes through the opening for engagement with the presenter which is located inside the opening and therefore not visible from the exterior of the machine. This may lead to customer confusion and mis-operation of a transaction.

SUMMARY

This relates more particularly to an Automated Transaction Machine (ATM) with an articulated note acceptor/presenter.

In at least one embodiment an automated transaction machine includes a housing forming an upper unit of the machine. A customer interface includes a fascia disposed about a front of the housing. The fascia has an opening through which currency may pass in to or out of the housing. An articulated note acceptor-presenter is operative to move within the upper unit and extend at least partially through the opening in the customer interface. The presenter has a pocket configured to receive one or more notes. The presenter pocket has a front wall, a rear wall and a bottom wall. A presenter carriage is disposed within the housing. The carriage is connected to the presenter pocket to translate the position of the presenter fore and aft relative to the customer interface to carry the presenter pocket toward and away from the opening in the customer interface and at least partially through the opening in the customer interface.

When the presenter is extended through the opening the pocket may be oriented at a substantial angle from vertical away from the fascia. The angle between the presenter and the fascia may be at least 10 degrees, 15 degrees, or 30 degrees. The fascia may extends upwardly at a substantial angle from vertical and toward the housing.

In at least one embodiment, the carriage is belt driven. In at least one embodiment the carriage is roller driven. And in at least one embodiment the carriage is neither belt nor roller driven.

The machine may include a note stripping assembly disposed in the housing and operative to strip notes from the presenter pocket in a deposit operation.

The machine may include a note stacking assembly disposed in the housing and operative to stack notes in the presenter pocket in a withdrawal operation.

The machine may include a note transport disposed in the housing and operative to transport notes between the presenter pocket and a validator in the upper unit.

The machine may include a lower unit including a chest and a note transport operative to transport notes between the upper unit and one or more cassettes located in the chest.

In at least one embodiment an automated transaction machine (herein "ATM" or "machine") accepts, stores, recycles and/or dispenses notes, bills, currency or any other type of document or medium of value or exchange including digital currency exchange or transactions (all collectively referred to herein generically as "notes"). Various embodiments include ATMs with a user or customer interface having a primary or single opening or throat through which notes are dispensed and through which notes are deposited into the ATM.

DETAILED DESCRIPTION

Figure 1:
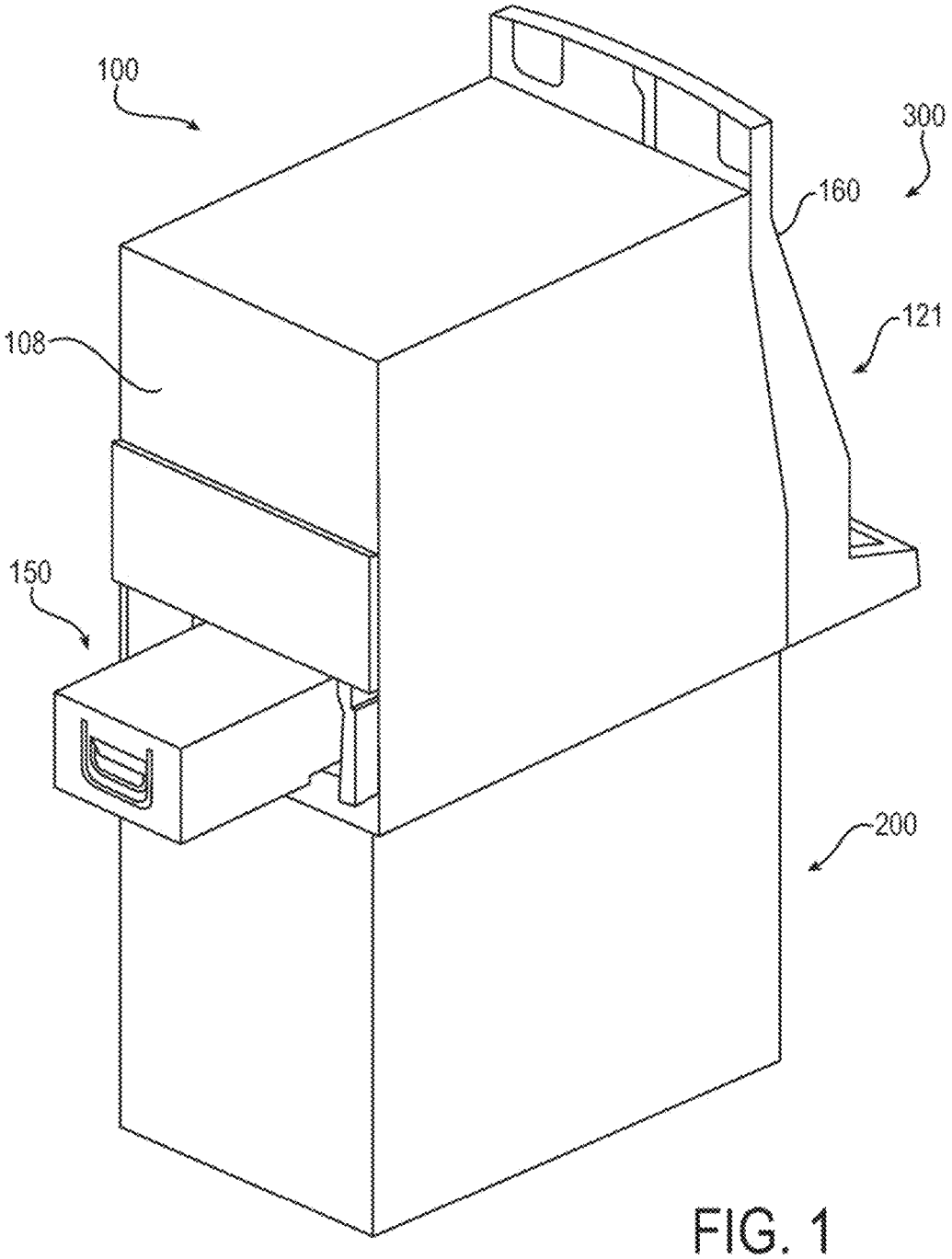
FIG. 1 is a rear perspective view of an Automated Teller Machine, shown with an escrow cassette partially removed.
Figure 2:
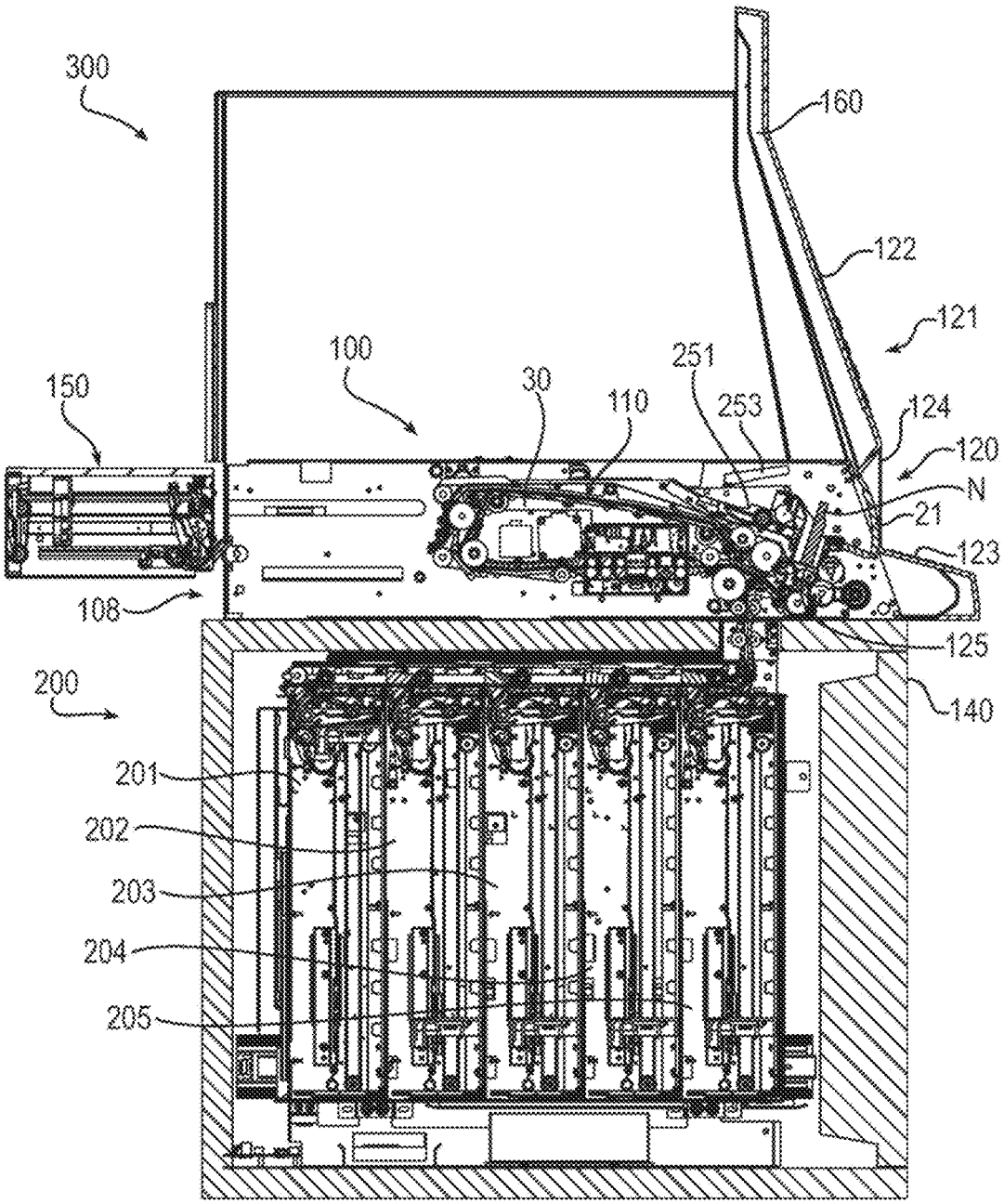
FIG. 2 is a side cross-sectional view of the ATM of FIG. 1.
Figure 3:
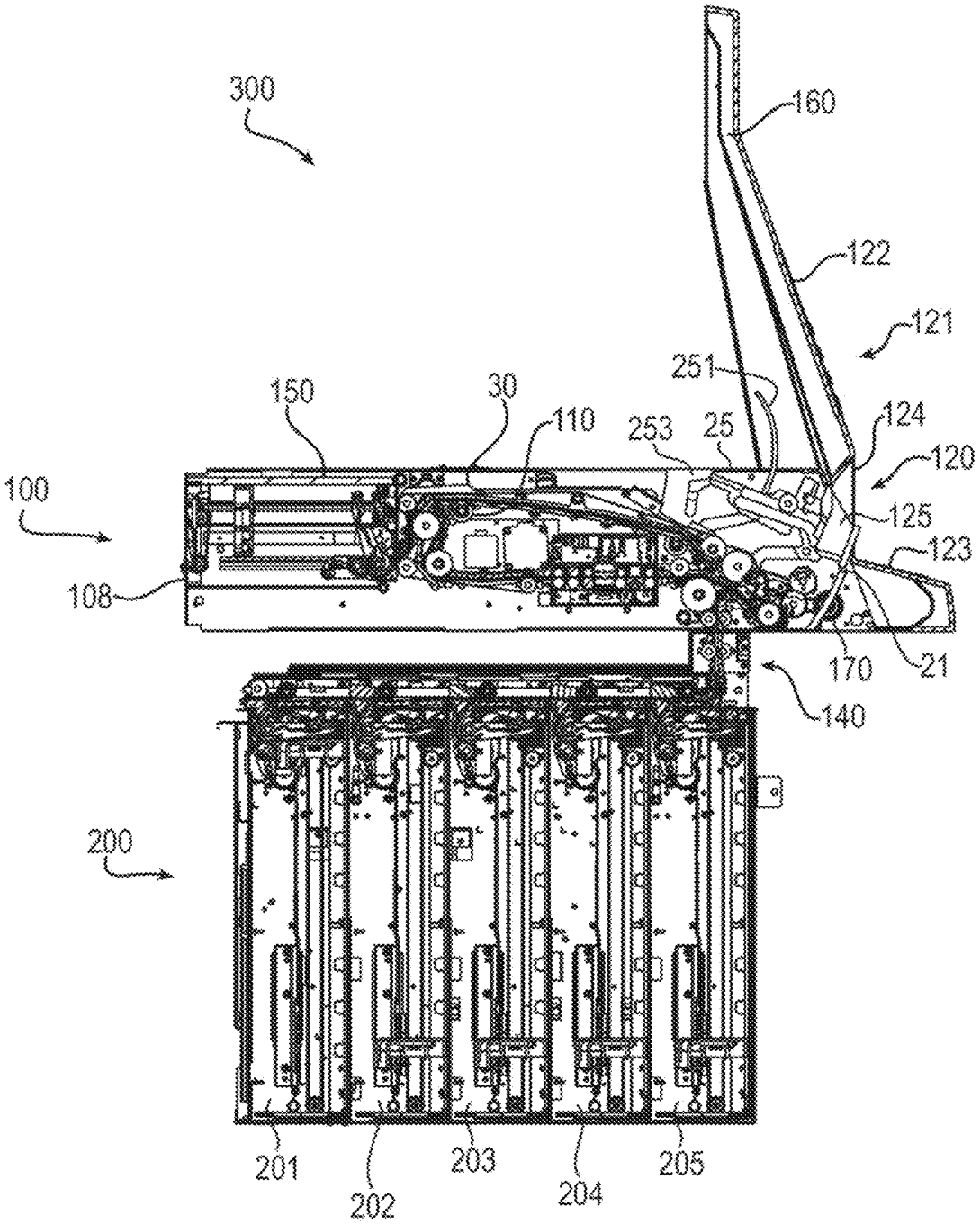
FIG. 3 is a view similar to FIG. 2, except with a portion of the housing and the chest removed and showing the escrow cassette in the normal operating position.

Referring now to the drawings, there is illustrated in FIGS. 1-3 an Automated Teller Machine (ATM) 300. The ATM has a housing or upper unit 100, which includes a user interface, generally indicated at 121. The user interface 121 includes devices and components operable by a user for control and use of the ATM. For example, the user interface 121 may include a display 122, a keypad 123 such as an encrypting pin pad (EPP), a card reader, located for example at 124, which may be a magnetic card reader or smart card or chip-in-card reader operable by manual insertion and retraction of a card into and out of a card slot or motorized card movement, configured for either short-edge or long-edge insertion into the card slot, such as for example a Diebold ActivEdge™ card reading device, or any other device suitable for operation of the ATM 300. A deposit module 125, accessed through an opening 120 in the user interface 121, is configured to receive one or more notes or documents for deposit or processing, such as for example a stack of currency notes, and also to dispense one or more currency notes such as a stack of bills in any denomination or combination. In another embodiment, the ATM 300 may be configured to additionally receive and verify checks or other negotiable instruments, or bearer instruments. Other components and devices of the user interface 121 may include one or more displays, touch screen displays, audio speakers, microphones, biometric devices such as iris scanning devices, fingerprint reading devices, voice recognition devices, user or facial recognition devices, infrared transmitters and receivers and other devices which are capable of receiving or providing information or data from and to users of the machine, or any other device suitable for interaction between a user and the ATM 300.

The machine 300 may optionally include other devices such as a receipt printer (not shown) that produces receipts to customers as records of machine transactions. Other possible devices include a journal printer (not shown) for making a paper record of transactions and a passbook printer (not shown). A check imaging device (not shown) may also be included for purposes of producing electronic images of checks deposited into the machine as well as for canceling such checks. Such a check imaging device may be of the type disclosed for example in U.S. Pat. No. 5,422,467.

Other devices include video cameras (not shown) for connecting to a remote location, an envelope deposit accepting mechanism (not shown), ticket printing devices (not shown), devices for printing statements (not shown), and other devices.

The machine 300 also includes a control system, schematically indicated at 30, which may be located in the housing 100. The control system 30 includes one or more programmed microprocessors and accompanying control circuitry in operative connection with the components of the machine and controls the operation thereof in accordance with programmed instructions. The control system 30 also provides for communications with other computers concerning transactions conducted at the machine 300. Such communications may be provided via a connection to a proprietary transaction network, via digital or optical cable, telephone lines or wireless connection, or any other suitable arrangement for communication between the ATM 300 and another computer(s).

For purposes of this description except where indicated otherwise, the words "documents", "sheets", "notes" and "currency" are used interchangeably to refer to materials received, transported, stored and/or dispensed by the machine 300 in any of its various embodiments. As known in the art, the process of recycling involves receiving documents singly or in bulk from a customer via the user interface, identifying the type of documents deposited, and storing the documents in one or more cassettes within the machine. The stored documents may then be selectively retrieved and provided as withdrawals from the machine, as further described.

As illustrated in FIGS. 1-3, and previously discussed, the ATM 300 includes a housing 100, generally illustrated as an upper unit, although such configuration is not required, and a chest 200, generally illustrated as a lower unit, although such configuration is not required. The housing 100 includes the receiver 125 and a receiver carriage assembly 25, a housing note transport conveyor 110, a validator 105, an escrow area or device 150 for example in the form of an escrow cassette as further described below, and the conveyance path 140. The front fascia 160 forms part of an exterior facing user interface by which the ATM is operated. The user interface may include—in addition to the display, keypad and card reader—other mechanical and/or contactless or wireless card reading devices, one or more cameras, biometric reading or sensing devices, wireless communication devices such as Near Field Communication (NFC) receivers and transceivers or Wi-Fi "hotspot" connections to networks and portable devices such as smart phones, audio speakers, microphones, earplug jacks, mirrors, keypad shields, and lights for general illumination and indicator lights such as at the card reader and/or at the deposit/dispense opening.

Located in the chest 200 are multiple cassettes 201, 202, 203, 204, and 205 configured to receive documents, such as notes, or checks or bills or the like. In the illustrated embodiments, the cassettes 201, 202, 203, 204, and 205 are oriented vertically to stack notes or documents horizontally therein. However, other orientations of the cassettes can be made, such as horizontal or at any suitable angle between horizontal and vertical. Notes and documents (these terms used synonymously herein to refer to any type of currency, voucher, ticket, paper, sheet or product which can be received, transported or moved by the ATM 300) that are identified and approved by the validator 105 are transported via the conveyance path 140 to one of the cassettes 201, 202, 203, 204, and 205 per programmed control logic of the ATM 300. As further described, the control and operation of the various gates, document and note transport mechanisms and cassettes is performed by a control system, for example located in the housing 100, configured, and programmed for operational control of note transport mechanisms for the described movement of documents in the ATM 300.

In a deposit operation, one or more notes or documents may be placed in the receiver 125, which may be for example be in the form of a box or compartment accessible through the opening 120 in the user interface 121. Notes may be clamped or gripped in the receiver 125 and the receiver may then be retracted into the housing 100. The notes are thereafter removed from the receiver 125, sent through the validator 105, and temporarily stored in the escrow cassette 150.

In one process, the analysis of the notes by the validator 105 produces signals indicative of note type and denomination or monetary amount, or a rejection of the note as invalid. These signals are transmitted to the control system 30, which controls the note transport to direct the notes to a delivery/reject area in the housing 100.

Then, identified documents suitable for acceptance and deposit may then be routed to the escrow cassette 150. The routing of identified sheets to the escrow position is optional depending on the programming of the control system 30 of the machine 300 or customer inputs to the interface of the machine 300. Notes classified as acceptable and identifiable may be directly routed to any of the cassettes 201, 202, 203, 204 and 205 for storage and possibly later re-dispensing.

In this example, the control system 30 controls transaction flow for analysis of notes and documents and routing to the reject, delivery, and escrow areas and cassettes.

If a note is not identifiable or identified as unacceptable, that note may be routed to a reject position for return to the customer via the receptacle 125. Note stacking, unstacking, and identifying/validating steps may be performed concurrently as each document in the stream of documents passes through the note transport. Preferably, notes are continuously directed to the escrow or reject positions until the deposited note stack has been completely unstacked.

Notes that are not acceptable, such as, for example, unidentifiable sheets, and sheets that appear suspect, may be returned to the customer through the user interface 121 via the receptacle 125. This can be done by the machine 300 after displaying to the customer, through the user interface display, information on the number of documents that were unidentifiable or unacceptable in the deposit stack that they submitted. The control system may also calculate a value of the acceptable documents and the customer would be advised through the interface of the value of the documents that have been properly identified.

In the illustrated embodiment, the escrow cassette 150 is located in the housing 100 in an area spaced from the user interface 121 and opening 120, and more particularly, in this example, proximate to a back side 108 of the ATM 300. In other embodiments, the escrow cassette 150 may be located toward the middle of the housing 100 or even proximate the front fascia 160.

The escrow cassette 150 is preferably removeable from the housing 100. This may further enable removal of rejected or diverted notes and/or replenishment and/or depletion of notes of any of the cassettes 201, 202, 203, 204, and 205 by conveyance operation as described. As illustrated, the escrow cassette 150 is mounted to slideably engage the housing directly, although such is not required. Alternatively, the escrow cassette may be mounted on rollers, track, fabricated slides, or any other arrangement suitable to facilitate removal and insertion of the escrow cassette 150 from and to the housing 100. In other embodiments, the escrow cassette 150 may be fixed in the housing 100 and the interior of the escrow cassette 150 may be accesses through an aperture in the escrow cassette 150, which may optionally include a moveable cover. Further, in the illustrated embodiment, opening is provided in the back side 108 for removal of the escrow cassette 150 from the housing 100. However, such an opening maybe placed anywhere desired, as practical, in the housing 100. Additionally, it is contemplated that that the escrow cassette 150 may be removeable from an open or exposed housing, rather than through an aperture. For example, the escrow cassette 150 may be lifted out of position when the machine 300 is in a service state, such as when the housing 100 is opened or when the contents are extended there from. In such a case, the escrow cassette may mount on mating terminals in the housing 100, may engage bolts or other fasteners, or may cooperate with any other suitable engagement to retain the escrow cassette in the housing 100.

In one operational scheme, when the machine 300 determines that certain documents may be unidentifiable or unacceptable a user may be given the option to instruct the machine 300 to reprocess the documents to again try to identify the documents and categorize them as acceptable. In such a scheme, the machine 300 may be programmed to run the rejected document(s) back through the central transport in the manner previously done with the deposited stack. Preferably, only the unidentifiable or unacceptable are rechecked. Alternatively, however, all of the documents, including the documents that have been identified and categorized as acceptable, may be rechecked. The procedure for recheck may be preprogrammed into the machine 300 or may be dependent upon selection from the customer.

If only the initially rejected documents are re-checked, and any determined to be acceptable, the control system will recalculate the number and/or value of the acceptable documents. The customer may then be given various options depending on the situation that arises, such as to compete the deposit and return any remaining unidentified or unacceptable documents, or to cancel the transaction in its entirety. Further, the machine 300 may be programmed to perform other variations of these operational sequences for receiving, validating, accepting, or rejecting notes. In the instance where the rejected stack is to be returned to the customer, it may be delivered to the customer via the receptacle 125.

If so programmed, the machine 300 may hold the identified documents in the escrow cassette 150 until it receives the customer input command to deposit the notes. At that point, the note transport may be activated to transfer notes from the escrow cassette 150 to one of the storage cassettes 201, 202, 203, 204, and 205 via the conveyance path 140.

In one operational example, the machine 300 may provide for crediting the customer's account for amounts that they indicated they wished to have returned but did not take. If the machine 300 is programmed to operate in this manner the documents in the escrow stack will be stored according to their type and denomination in the various storage areas in the cassettes 201, 202, 203, 204 and 205. In this case, the control system will operate to credit the customer's account for a deposit. This may be done by the control system updating account data stored in memory in a machine at the customer's financial institution and/or by exchanging transaction messages with a remote computer system that tracks debit or credit card transactions for reconciliation.

In another operational example, the retracted documents may be stored in one of the cassettes 201, 202, 203, 204, and 205 and the machine may be programmed to detail the incomplete transaction and commit the incomplete transaction to memory and/or transmit the incomplete transaction to another computer. This may occur, for example, the user forgets to take a document(s) or is distracted while performing their transaction. The memory of the machine or other connected transaction systems may store this record of the incomplete transaction, such that the next time the customer accesses the machine, or other computer of the connected transaction system, the user may be notified of the fact that they had an incomplete transaction. The interface of the machine 300 may be used to notify the customer of the incomplete transaction and may prompt them concerning completion, reversal or other options relating to the transaction. The user may then input instructions to complete or otherwise close the transaction. This feature may limit the customer's options for completing the transaction to the particular machine where the incomplete transaction occurred or may be accessible from the other computer of the transaction system, such as, when the record of the incomplete transaction is stored in the memory of a transaction system which is connectable to many machines, the customer may be allowed to complete the transaction at a different machine.

It is expected that in most cases when a customer has deposited documents in the machine, they will choose to have funds credited to their account. In the ensuing transaction flow, the customer would indicate through the user interface that they wish to make a deposit. The control system would put the machine 300 in deposit mode and proceed accordingly. This is done in the manner previously described for the deposited stack.

The identification of the bill type may be used to selectively route each document to the storage area where documents of that type are stored, e.g. cassette 201, 202, 203, 204, and 205. It should also be understood that the memory connected to the control system of the machine 300 may preferably programmed to record the type of document held in the escrow stack and to compare the document type determination made in the initial pass to the type determination made in the second pass. In the event of an error or inconsistency, a divert gate may be used to route any irregular documents to the delivery/reject area instead of moving them down into a storage location in the machine 300, or moving them into another selected storage location.

In at least on process, each note undergoes analysis in the manner described and if the note is identified and validated, the machine continues in deposit mode and each note is dispatched to an appropriate storage location, e.g. one of cassettes 201, 202, 203, 204, and 205. In such an operation, notes may be moved concurrently toward different storage locations under the control of the control system.

Figure 4A:
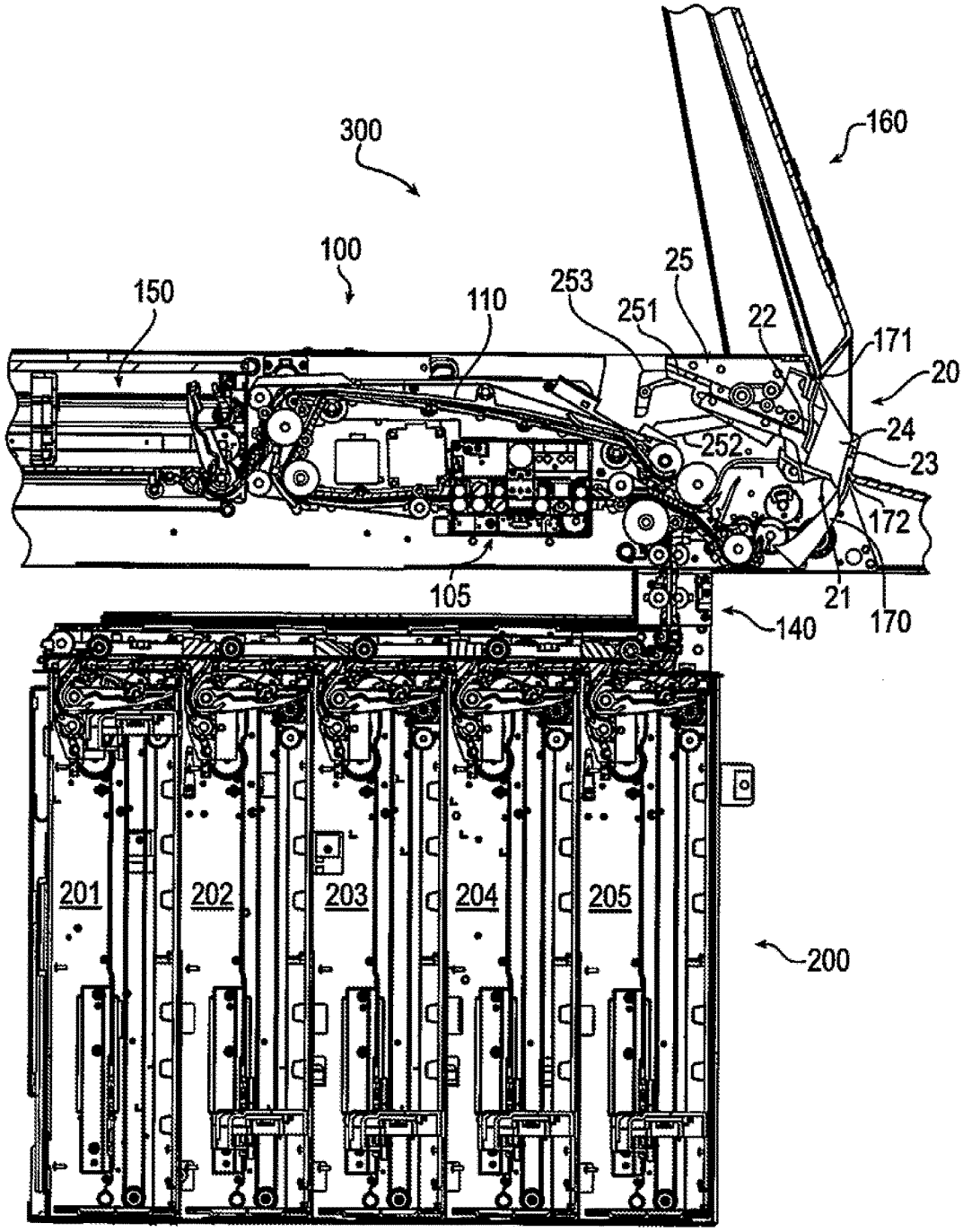
FIGS. 4A-4D are cross-sectional views similar to FIG. 3 except showing the stack receiver and presenter in various configurations for acceptance and processing of one or more notes or documents for deposit.

Illustrated in FIGS. 4A through 4D and 5A through 5C, a note receiver, indicated generally at 20, is disposed at an angle between horizontal and vertical as viewed in profile, as for example in shown in FIG. 4A. The receiver 20 is in the form of a generally rectangular bin or box with a floor or bottom wall 21, a rear wall 22, a front wall 23, and side walls 24. A width dimension of the receiver bin being defined between the side walls 24, and a depth dimension between the front wall 23 and rear wall 22, the depth dimension being adequate to accommodate notes and note stacks of various sizes. The bottom wall 21 is disposed at an acute angle relative to a horizontal reference plane through the ATM, and the front wall 23 and rear wall 22 disposed at acute angles relative to a vertical reference plane through the ATM. Also, in some embodiments, the receiver 20 is in this generally angular orientation throughout the various stages of operation as further described.

As further illustrated in FIG. 4A, a general configuration of an ATM, indicated generally at 300, includes an upper unit indicated generally at 100 and a lower unit, indicated generally at 200. The upper unit 100 includes the receiver 20 and a receiver carriage assembly 25, upper unit note transport conveyor 110, validator 105, escrow 150 for example in the form of an escrow cassette, and the conveyance path 140. A front fascia 160 forms part of an exterior facing customer interface by which the ATM is operated. Additional components of a customer interface 160 may include a display, a keypad, card readers such as mechanical and/or contactless card reading devices, one or more cameras, biometric reading or sensing devices, wireless communication devices such as NFC receivers and transceivers or Wi-Fi "hotspot" connections to networks, audio speakers, microphones, earplug jacks, mirrors, keypad shields, and lights for general illumination and indicator lights such as at the card reader and/or at the deposit/dispense opening.

Located in the lower unit 200 are multiple canisters or cassettes 201-205 configured to receive stacks of notes of any type or denomination or documents such as checks or bills. In the illustrated embodiments, the cassettes 201-205 are oriented vertically to stack notes or documents horizontally therein. However, other orientations of the cassettes can be made, such as horizontal or at any angle between horizontal and vertical. Notes and documents (these terms used synonymously herein to refer to any type of currency, voucher, ticket, paper, sheet or product which can be received, transported or moved by the ATM) that are identified and approved by the validator 105 are transported via the conveyance path 140 to one of the cassettes 201-205 per the ATM control logic. As further described, the control and operation of the various gates, document and note transport mechanisms and cassettes is performed by a control system, for example located in the upper unit 100, configured and programmed for operational control of note transport mechanisms for the described movement of documents in the ATM.

As shown in each of the FIGS. 4A through 4D, a gate 170 is co-located with or exposed through the front fascia 160. The gate 170 is operative to move between open and closed positions, to cover a gate opening which is between an upper frame 171 and a lower frame 172, for example by mechanized movement behind the front fascia, in order to cover and uncover the gate opening in the fascia 160 through which the receiver 20 extends and retracts in an angled or canted orientation. In this particular embodiment as illustrated, the gate 170 moves to a retracted open position past or behind the lower frame 172, although it could be alternately configured to retract behind the upper frame 171. In a stand-by or offline mode, the gate 170 is closed. When a transaction with the ATM is initiated by a customer which involves depositing or dispensing notes, the gate 170 is opened by the control system to allow the receiver 20 to extend through the gate opening to receive one or more documents or for dispense of one or more documents.

Figure 4B:
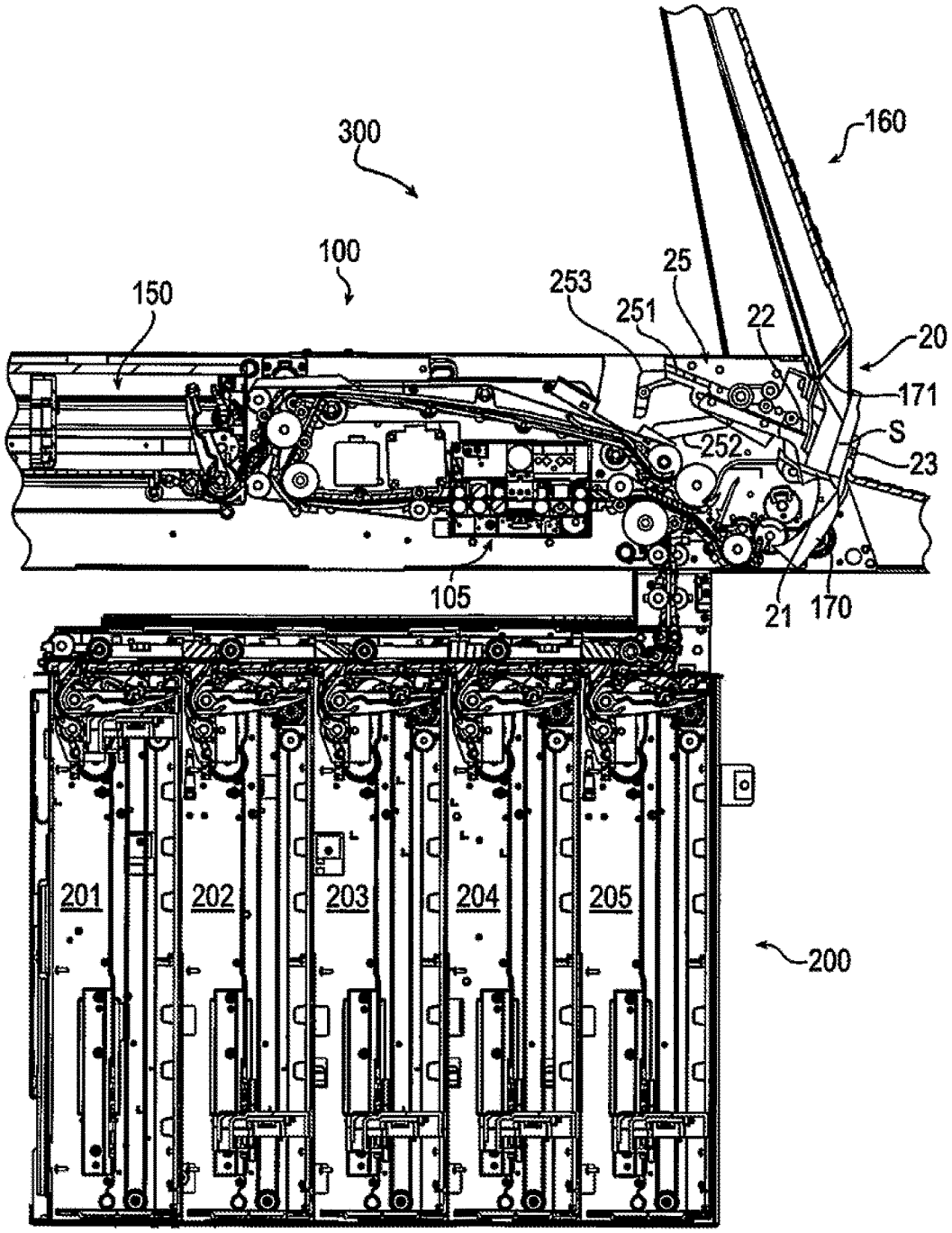
Figure 4C:
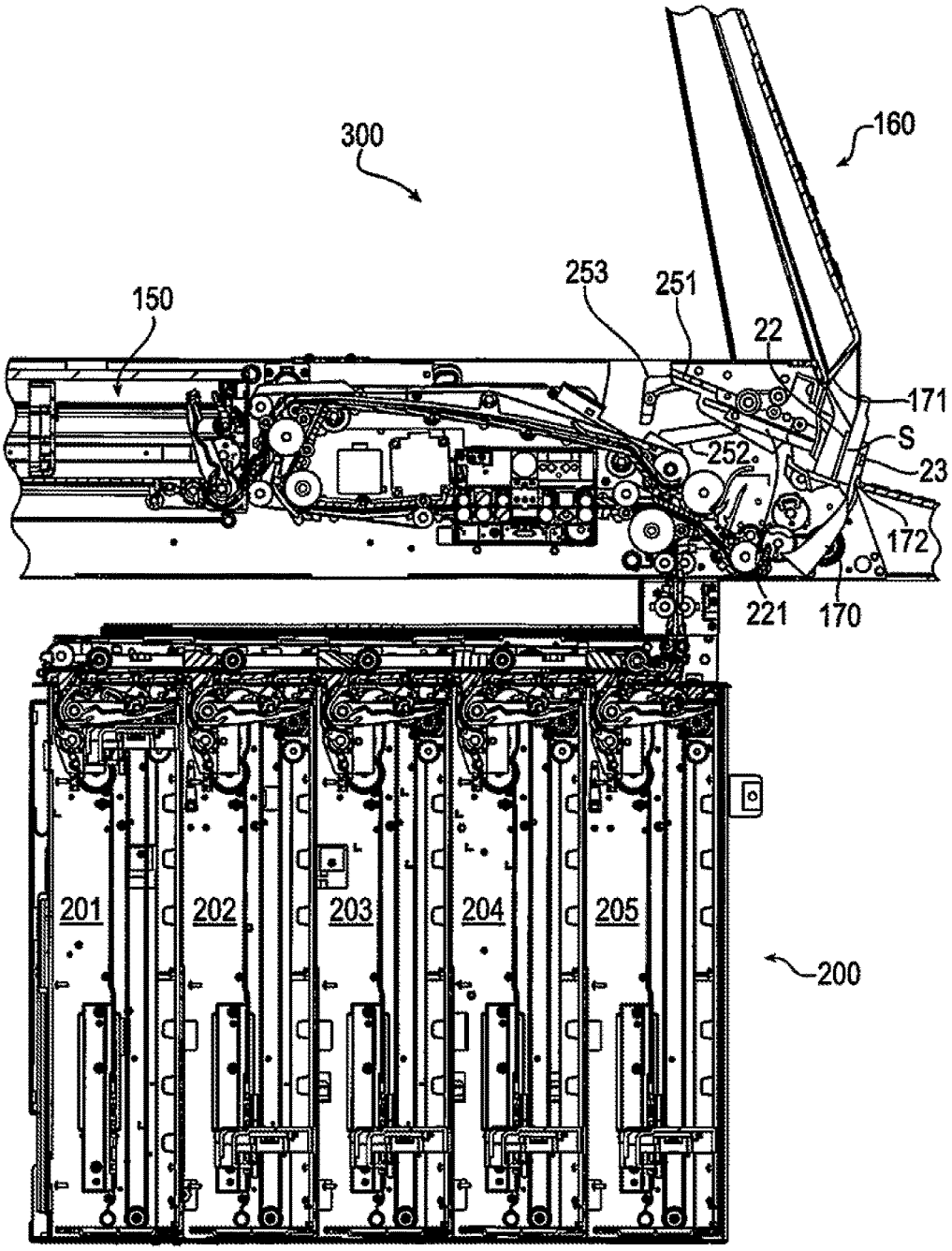
Figure 4D:
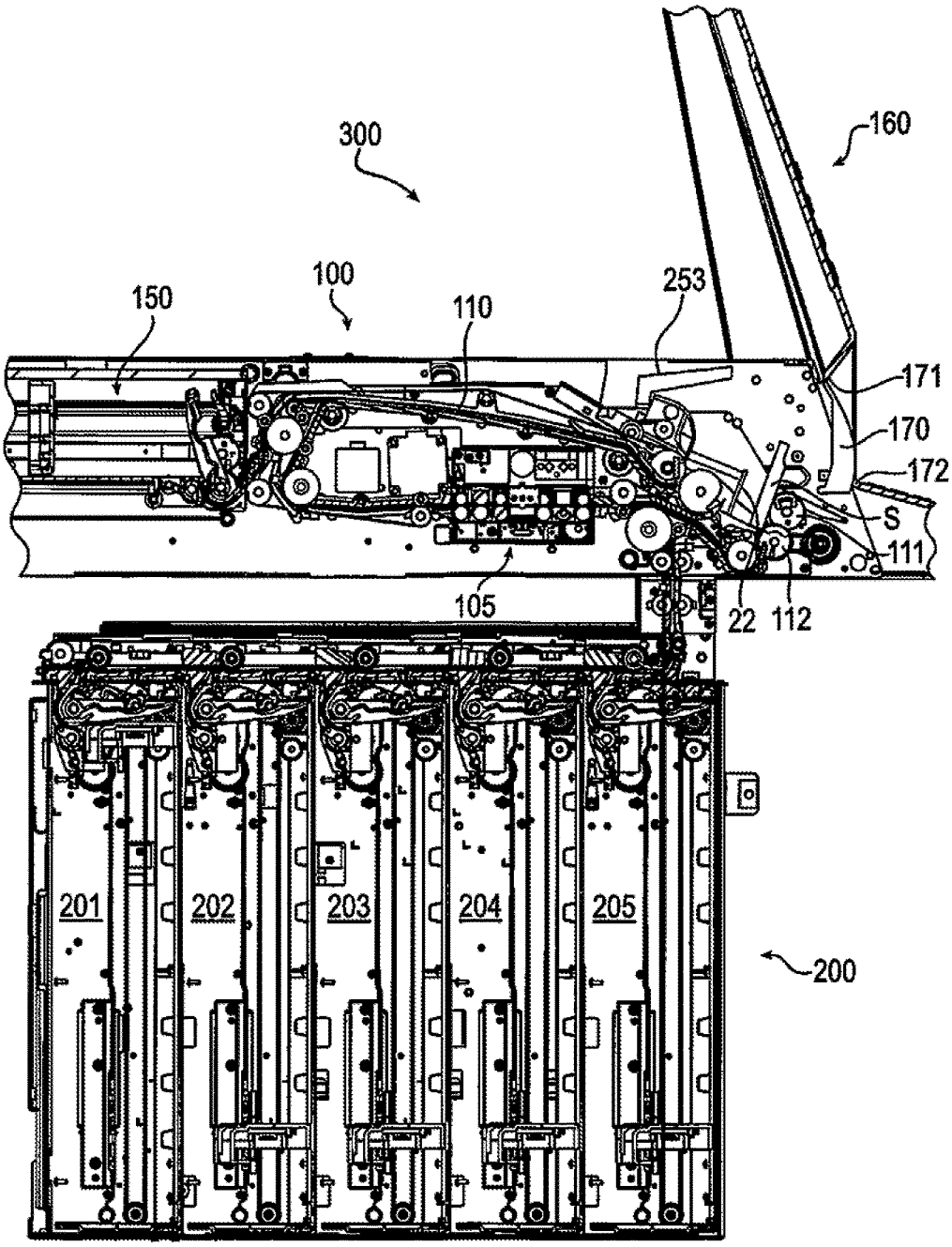

FIG. 4B illustrates a stack S of notes positioned in the receiver 20, with the stack S positioned against the front wall 23, with some additional space in the receiver for additional notes. As shown in FIG. 4C, the rear wall 22 is attached to an arm 221, which moves in track 2221 to move the rear wall 22 toward the front wall 23 to clamp the stack S there between. Once the stack S is clamped in the receiver 20, the receiver is then retracted back through the gate opening along track 252 to an interior side of the fascia 160 to the fully retracted position shown in FIG. 4D. Arm 221 and attached rear wall 22 are mounted for translation in a separate carriage which moves within track 253, which as illustrated has a generally horizontal leg and a generally vertical leg in order to retract with the carriage assembly 25 as illustrated. The gate 170 is thereafter closed in the position shown in FIG. 4D. The rear wall 22 is then retracted to the position shown in FIG. 4D, leaving the stack S unclamped in the receiver 20 and ready to feed to the conveyor 110, for example by operation of feed wheels 111 and 112, for conveyance through the upper unit 100 and its attendant operations.

In a preferred embodiment as illustrated, the carriage assembly 25 is generally angularly disposed relative to a vertical reference plane with which the fascia or front of the ATM is generally aligned, and with respect to a horizontal reference plane, such as the bottom wall of the upper unit 100. Also, the track 252 along which the receiver carriage assembly 25 moves is oriented at an upward angle from an interior of the upper unit 100 toward the gate opening. This orientation and operational path or trajectory of the receiver 20 is structurally and functionally very different from prior art configurations wherein an opening or cavity for a stack of notes is in a fixed position and is accessible through an opening which is in a horizontal or vertical plane. The receiver and presenter of the present disclosure also differs from the prior art in that the receiver 20 extends beyond and over or under the gate 170 while in the receiving and presenting modes as described, whereby the gate 170 is prevented from closing due to the presence of the receiver, and the gate 170 is allowed to close only when the receiver 20 is fully retracted into the interior of the ATM. This orientation and operational path also provides for teed and stack mechanism(s) to be hidden from consumer/user view, while not requiring consumers/users to have any part of their hands beyond the fascia plane.

Figure 5A:
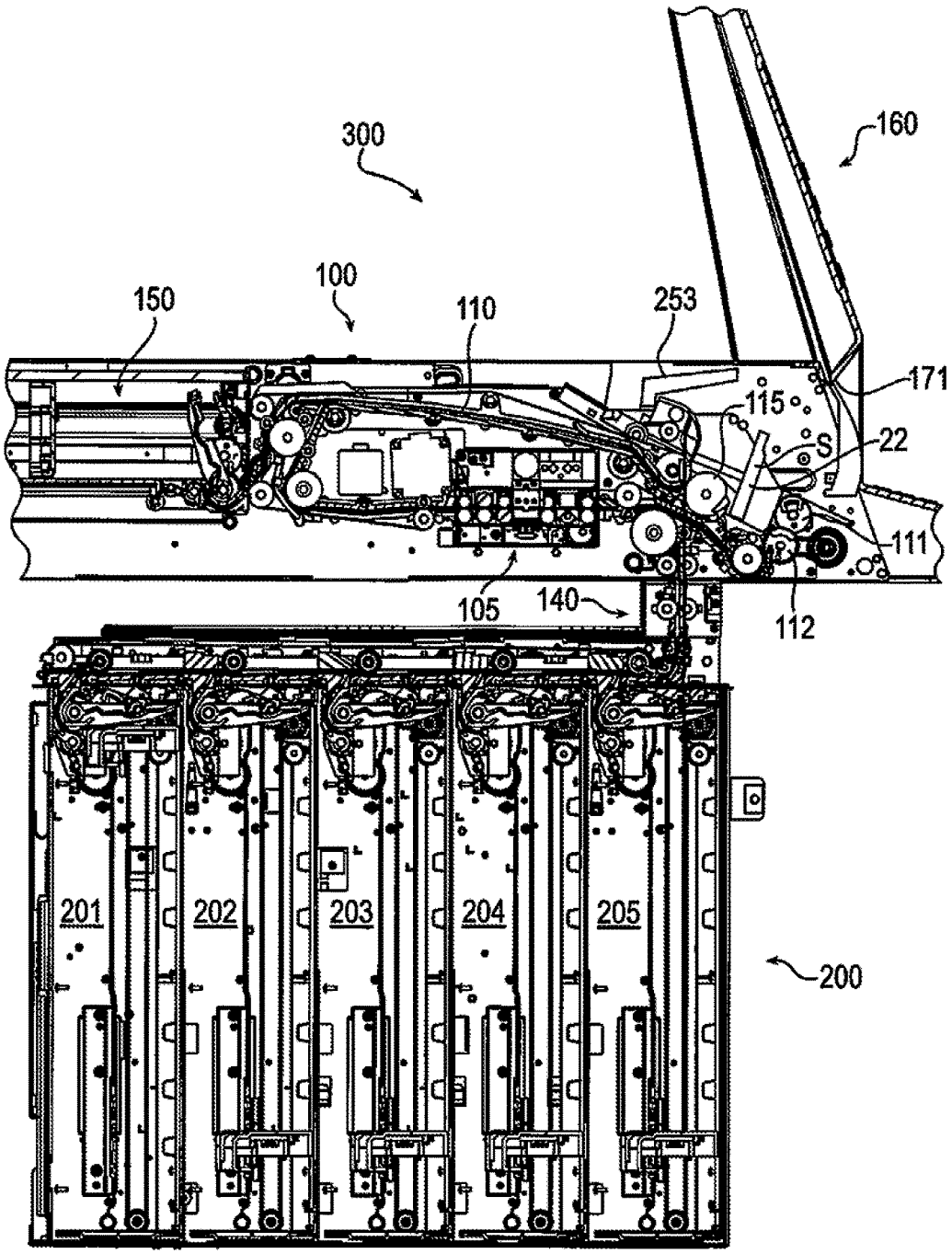
FIGS. 5A-5C are cross-sectional views similar to FIG. 3 except showing the stack receiver and presenter in various configurations for stacking and presenting one or more notes or documents for withdrawal.
Figure 5B:
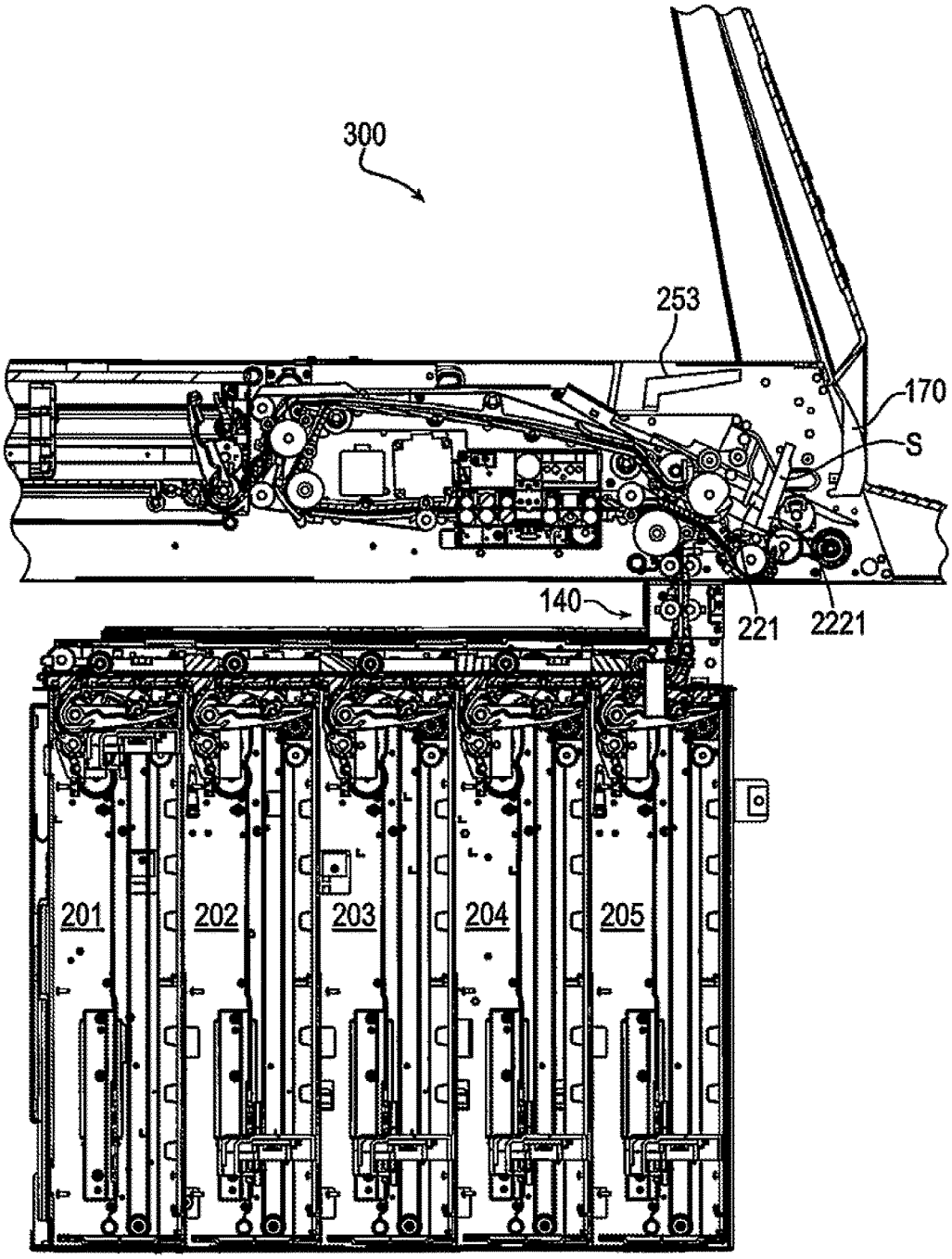
Figure 5C:
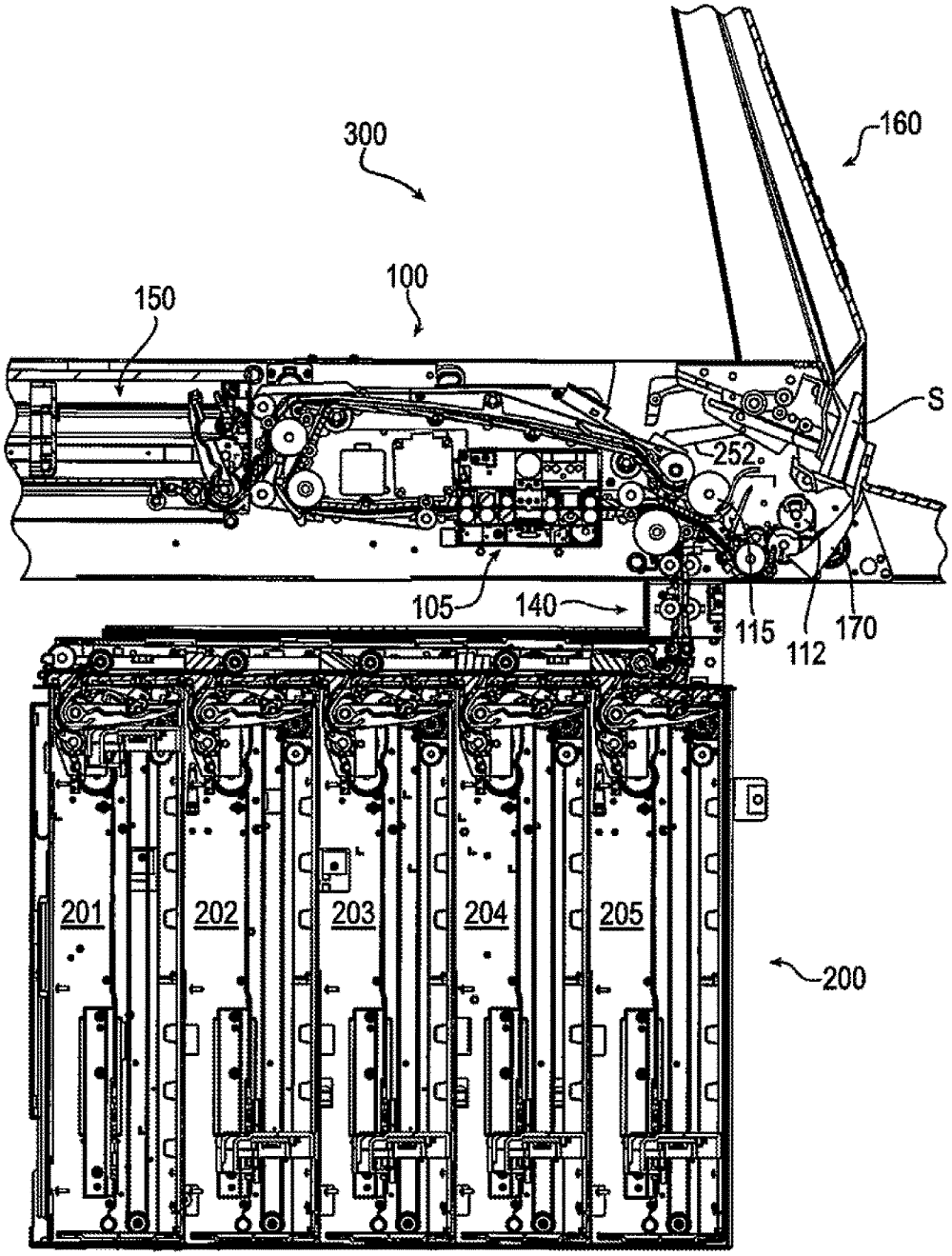

FIGS. 5A through 5C illustrate the ATM 300 with the receiver 20 in various operations and configurations for dispensing notes through the gate opening. As shown in FIG. 5A, a stack S is loaded into the receiver 20, for example in part by feed wheel 115 and on an opposite or high side of rear wall 22 as compared to a stack in the deposit location in the receiver 20. The gate 170 remains closed as shown during the stacking operation. As shown in FIG. 5B, once the stack is completed, the arm 221 and rear wall 22 are advanced toward the front wall 23 with the stack S resting on the bottom wall 21. A secondary clamp 2211 at a forward end of arm 221 clamps the stack S against the high side of the rear wall 22 in order to clamp the stack S prior to presenting.

For presentation of the stack S, as shown in FIG. 5C the gate 170 is moved to the open position and the carriage assembly 25 is advanced along track 252 toward the gate opening, returning the receiver 20 to the position shown in FIG. 4A. The secondary clamp 2211 remains in pressure contact with the stack S in an amount sufficient to keep the stack in place but which allows for manual withdrawal of the stack from the receiver 20.

It has been discovered that consumers/user generally prefer an angled input for the deposit of items; that a hidden mechanism is less intimidating to consumers/users and a hidden mechanism reduces the occurrence of foreign objects being inserted into and possibly causing damage of the machine.

While principles and modes of operation have been explained and illustrated with regard to particular embodiments, it must be understood, however, that this may be practiced otherwise than as specifically explained and illustrated without departing from its spirit or scope.

What is claimed is:

1. An automated transaction machine comprising:

a housing forming an upper unit of the machine;

a customer interface including a fascia disposed about a front of the housing, the fascia having an opening through which currency may pass in to or out of the housing;

an articulated note acceptor-presenter operative to move within the upper unit and extend at least partially through the opening in the customer interface, the presenter having a pocket configured to receive one or more notes, the presenter pocket having a front wall, a rear wall and a bottom wall, the articulated note acceptor-presenter connected to a presenter carriage assembly disposed within the housing, the carriage assembly connected to the presenter pocket to translate the position of the presenter fore and aft relative to the customer interface to carry the presenter pocket toward and away from the opening in the customer interface and at least partially through the opening in the customer interface;

a validator disposed in the housing;

a note transport disposed in the housing and operative to transport notes between the presenter pocket and the validator; and a lower unit of the machine including a chest with one or more cassettes disposed therein, wherein the note transport is also operative to transport notes between the upper unit and the lower unit.

2. The machine of claim 1 where when the presenter is extended through the opening the pocket is oriented at a substantial angle from vertical away from the fascia.

3. The machine of claim 2 where the angle between the presenter and the fascia is at least 10 degrees.

4. The machine of claim 2 where the angle between the presenter and the fascia is at least 15 degrees.

5. The machine of claim 2 where the angle between the presenter and the fascia is at least 30 degrees.

6. The machine of claim 2 where the fascia extends upwardly at a substantial angle from vertical and toward the housing.

7. The machine of claim 2 where the carriage is belt driven.

8. The machine of claim 2 where the carriage is roller driven.

9. The machine of claim 1 further comprising a note stripping assembly disposed in the housing and operative to strip notes from the presenter pocket in a deposit operation.

10. The machine of claim 1 further comprising a note stacking assembly disposed in the housing and operative to stack notes in the presenter pocket in a withdrawal operation.

11. The machine of claim 1 further comprising a note transport disposed in the housing and operative to transport notes between the presenter pocket and a validator in the upper unit.

12. The machine of claim 1 further comprising a lower unit including a chest and a note transport operative to transport notes between the upper unit and one or more cassettes located in the chest.

13. The machine of claim 12 where when the presenter is extended through the opening the pocket is oriented at a substantial angle from vertical away from the fascia.

14. The machine of claim 13 where the angle between the presenter and the fascia is at least 10 degrees.

15. The machine of claim 13 where the angle between the presenter and the fascia is at least 15 degrees.

16. The machine of claim 13 where the angle between the presenter and the fascia is at least 30 degrees.

17. The machine of claim 12 where the fascia extends upwardly at a substantial angle from vertical and toward the housing.

18. An automated transaction machine comprising:

a lower unit including:

a chest with one or more storage cassettes disposed therein; and an upper unit including:

a housing;

a customer interface including a fascia disposed about a front of the housing, the fascia having an opening through which currency may pass in to or out of the housing;

an articulated note acceptor-presenter operative to move within the housing and extend at least partially through the opening in the customer interface, the presenter having a pocket configured to receive one or more notes, the presenter pocket having a front wall, a rear wall and a bottom wall, the note acceptor-presenter connected to a presenter carriage assembly disposed within the housing, the carriage assembly connected to the presenter pocket to translate the position of the presenter fore and aft relative to the customer interface to carry the presenter pocket toward and away from the opening in the customer interface and at least partially through the opening in the customer interface;

a validator disposed in the housing;

an escrow cassette disposed in the housing; and a note transport disposed in the housing and operative to transport notes between the presenter pocket and the validator, and operative to transport notes between the validator and the escrow cassette, and operative to transport notes between the upper unit and the lower unit.

* * * * *